US009657467B2

(12) United States Patent
Stein et al.

(10) Patent No.: US 9,657,467 B2
(45) Date of Patent: May 23, 2017

(54) SANITARY INSERT UNIT

(71) Applicant: Neoperl GmbH, Mullheim (DE)

(72) Inventors: Alexander Stein, Ihringen (DE); David Birmelin, Mullheim (DE)

(73) Assignee: Neoperl GmbH, Müllheim (DE)

( * ) Notice: Subject to any disclaimer, the term of this patent is extended or adjusted under 35 U.S.C. 154(b) by 392 days.

(21) Appl. No.: 14/168,074

(22) Filed: Jan. 30, 2014

(65) Prior Publication Data

US 2014/0217202 A1 Aug. 7, 2014

(51) Int. Cl.

| | |
|---|---|
| ***E03C 1/08*** | (2006.01) |
| ***B05B 1/16*** | (2006.01) |
| ***B05B 1/30*** | (2006.01) |
| *E03C 1/02* | (2006.01) |

(52) U.S. Cl.

CPC ..... *E03C 1/08* (2013.01); *B05B 1/1609* (2013.01); *B05B 1/3006* (2013.01); *E03C 2001/026* (2013.01)

(58) Field of Classification Search

CPC B05B 1/14; B05B 1/16; B05B 1/1609; B05B 1/1627; B05B 1/1663; B05B 1/1681; B05B 1/30; B05B 1/13006; B05B 1/3013; B05B 1/3026; B05B 1/3033; B05B 1/304; B05B 1/306; B05B 1/3006; E03C 1/08; E03C 2001/026

USPC ..... 239/436–441, 443–449, 452–453, 239/562–564, 570–571, DIG. 11

See application file for complete search history.

(56) References Cited

U.S. PATENT DOCUMENTS 3,061,199 A * 10/1962 Billeter ..... B05B 1/3006 239/109

7,431,224 B2 10/2008 Laker

* cited by examiner

*Primary Examiner* — Christopher Kim

(74) *Attorney, Agent, or Firm* — Volpe and Koenig, P.C.

(57) ABSTRACT

A sanitary insert unit (1) having an elastically deformable valve body (8) which can be switched between a first switching state and a second switching state and having a first flow path (3) and a second flow path (4). The second flow path (4) is blocked in the first switching state and open in the second switching state, and the first flow path (3) is open in the first switching state and in the second switching state.

25 Claims, 4 Drawing Sheets

SANITARY INSERT UNIT

INCORPORATION BY REFERENCE

The following documents are incorporated herein by reference as if fully set forth: German Patent Application No. DE102013001931.1, filed Feb. 2, 2013.

BACKGROUND

The invention relates to a sanitary insert unit, having an insert housing in which there are formed a first flow path and a second flow path, wherein the first flow path and the second flow path extend in each case between at least one inflow-side inlet opening and one outflow-side outlet end, and having a valve body which can be adjusted from a first switching state to a second switching state counter to a return force, wherein the second flow path is closed by the valve body in the first switching state and is open in the second switching state.

Insert units of this kind are known and have proven useful, for example in water fittings, for switching between a first jet emerging from the first flow path and a second jet emerging from the second flow path. The known solutions involve switching off or interrupting the first flow path while switching on or opening the second flow path, such that, in each switching state, only one flow path is opened, and the respective other flow path is closed.

A sanitary insert unit of the aforementioned type with an insert housing has previously been described in U.S. Pat. No. 7,431,224 B2, in which insert housing a first and a second flow path are formed. The invention previously described in U.S. Pat. No. 7,431,224 B2 proceeds from prior art in which, in the fitting outlet, an insert is provided which is intended to assist in the uniform distribution of the emerging flow across the cross-sectional area and, if appropriate, also to ensure a uniform distribution of hot and cold water, so as to minimize the risk of the user scalding his hands when the stream of hot water is not mixed correctly with the stream of cold water. The prior art cited in U.S. Pat. No. 7,431,224 B2 generally takes the form of a transverse plug which can be fitted in the outlet orifice and which has a plurality of axial bores running through it. The combined cross-sectional area of the bores is generally slightly smaller than the cross-sectional area that is needed to accommodate the full flow rate of water through the valve mechanism, such that the transverse plug causes a slight backpressure at the tap outlet in order to create a jet of water from the tap. However, when the tap valve is only partially opened, the combined cross-sectional area of the bores in the plug exceeds the cross-sectional area needed to accommodate the full flow rate of water through the plug. The water then issues from the tap outlet as a slow flow of water due to the lack of pressure drop across the plug. Since the slow flow of water does not fill the outlet orifice but instead issues as a shallow flow over an arc at the lower portion of the plug, the shallow flow of water not only gives the appearance of a slow rate of flow of the water, but is also esthetically unacceptable to the user since the flow is in the form of a sluggish dribble from the tap. In order to create an insert unit which responds to the flow or the pressure and which controls the outflow of water such that the water emerges in an arrangement of jets with low flow rates, but when necessary also permits the complete flow of water, it is proposed in U.S. Pat. No. 7,431,224 B2 that the inlet in the insert housing is connected to the outlet via a first flow path and a second flow path, wherein a valve is provided in the second flow path and frees the second flow path when the water pressure exceeds a threshold value. The emerging water therefore initially flows at a low water pressure through a first flow path arranged in a ring shape and, after a threshold value has been exceeded and the valve in the second flow path has been opened, the water is also allowed to emerge through the second flow path lying to the inside.

SUMMARY

The object of the invention is to offer an alternative design for a sanitary insert part.

According to the invention, in a sanitary insert part of the type described at the outset, it is provided that, on the valve body, there is formed a flow obstruction which is arranged in the first flow path, and flow can pass through the first flow path in the first switching state and in the second switching state. It is thus possible to ensure that, in the second switching state, both the first flow path and also the second flow path are opened. In the second switching state, the water can therefore flow simultaneously through the flow paths formed parallel to each other. The overall cross-sectional area of the flow paths in the second switching state can therefore be made larger compared to the previously known exclusive opening of just the second flow path, with simultaneous blocking of the first flow path. The formation of a flow obstruction in the first flow path has the advantage that a liquid flowing in the first flow path is able to develop a force for changing the valve body over to the second switching state. It is thus possible to achieve automatic change-over of the valve body when there is a sufficient water pressure in the first switching state.

In one embodiment of the invention, provision can be made that the flow obstruction is in the form of a throughflow opening. The throughflow opening thus forms a narrowing of the cross section in the first flow path. Thus, a flow obstruction can be easily created by narrowing the flow path in relation to adjacent (upstream and downstream) sections of the flow path. The throughflow opening preferably narrows in the flow direction. Thus, for example, a conically narrowing throughflow opening can be used. It is advantageous here that, by narrowing the flow path at the throughflow opening, a simple means is created whereby the valve body can be acted on and actuated according to the water pressure and/or the flow velocity/flow rate.

In one embodiment of the invention, provision can be made that the flow obstruction is formed on an inflow-side end of the valve body. It is advantageous here that the valve body can be easily acted on by incoming water in order to switch the valve body.

In one embodiment of the invention, provision can be made that, at the outflow side, the valve body is supported, via a support, on a support element which is rigidly connected to the insert housing. It is advantageous here that a change in shape of the valve body can be easily achieved by the insert housing acting as an abutment for the pressure applied on the valve body.

In one embodiment of the invention, provision can be made that the valve body can be transferred from the first switching state into the second switching state by a change in shape. The change in shape can be achieved here by elastic deformation of the valve body. It is advantageous here that a resistance to an elastic change in shape can be used to generate the return force that permits a transfer to the first switching state. Alternatively or in addition, provision can be made that the valve body can be transferred from the first switching state to the second switching state by a change in position. For example, the change-over can be obtained by a combined change in shape and change in position.

In one embodiment of the invention, provision can be made that the valve body has an elastic wall region. It is advantageous here that one region can be created for a defined change in shape.

In one embodiment of the invention, provision can be made that the or an elastic wall region is formed as a bending zone. Here, a bending zone is generally understood as a region which is oriented and configured in such a way that, when acted upon to change, the bending zone bends. The bending is characterized by a material deformation, which starts only when a threshold value of the acting force is exceeded, wherein the force needed for a continuation of the material deformation is smaller than the threshold value initially to be exceeded. This behavior can be generated, for example, by virtue of the fact that a force vector, which initially acts on a material of the elastic wall region, extends in this material and, after the bending starts, the material deforms in such a way that the still acting force vector withdraws from the material. An advantage of the bending in relation to an elastic deformation, for example according to Hooke's law (according to which the deformation is proportional to the deforming force), is that it is possible to establish a threshold value starting from which a change in shape takes place.

In one embodiment of the invention, provision can be made that the or an elastic wall region of the valve body has a rectilinear profile along a profile direction in the first switching state, and has a bent profile along the profile direction in the second switching state. A change in shape is thus attainable by bending.

In one embodiment of the invention, provision can be made that the or an elastic wall region is of hollow cylindrical form. Preferably, the elastic wall region surrounds the first flow path in sections and receives the latter in sections. It is advantageous here that the valve body can be acted on centrally by the water flowing in the first flow path. In this way, a defined adjustment movement of the valve body between a first switching state and a second switching state can be obtained.

In one embodiment of the invention, provision can be made that the valve body is in the form of a hollow body. Preferably, the hollow body receives the first flow path in sections. It is advantageous here that the first flow path is guided in a way that saves space. It is also advantageous here that branching of the second flow path from the first flow path can be formed by the valve body. For example, the valve body, except for the or a throughflow opening, can have a shape separating the first flow path from the second flow path after the branching.

In one embodiment of the invention, provision can be made that the valve body is of pot-shaped form, wherein at least one throughflow hole for the first flow path is provided in the bottom of the pot. The pot shape provides a simple way of branching the second flow path off from the first flow path. For example, the first flow path can be guided inside the pot shape, i.e. in an interior at least partially enclosed by the pot shape. The second flow path can be guided outside the pot shape. The pot shape is preferably produced with a liquid-tight wall, such that the flow paths can be separated from each other. In particular, provision can be made here that the flow obstruction, preferably as a throughflow opening, is formed on a face side of the pot-shaped valve body. It is advantageous here that, due to the flow resistance, the liquid flowing past the flow obstruction can develop a force by which the changing-over of the valve body can be driven. It is advantageous here that a force developed on the flow obstruction can be passed on to the lateral wall. The face side is preferably inelastic or rigid by comparison with the elastic wall region. It is particularly expedient here if the flow obstruction is formed centrally in relation to the face side. In this way, the valve body can be acted upon centrally and symmetrically on account of the liquid flowing through the flow obstruction, by which a defined change in shape and/or a defined change in position of the valve body can be effected at the change-over.

In one embodiment of the invention, provision can be made that a sealing surface is formed on the or an inflow-side face of the valve body, with which sealing surface the second flow path can be tightly closed in the first switching state of the valve body. Thus, a simple means can be made available for interrupting the second flow path in the first switching state.

In one embodiment of the invention, provision can be made that the valve body is of rotationally symmetrical form. It is advantageous here that a defined change in shape can be achieved in a simple way.

In one embodiment of the invention, provision can be made that the valve body is in unipartite form. This permits simple assembly. The valve body is preferably produced from an elastic material, for example from rubber. It is particularly advantageous if the valve body is produced from silicone or from a thermoplastic elastomer. The elastic properties of the material used can thus be exploited to develop a return force, which counteracts a change in shape from the first switching state to the second switching state.

It is thus possible that a spring element and/or the inherent elasticity of the material used for the valve body are/is provided for generating the return force for returning the valve body to the first switching state. In addition or instead, a particularly advantageous embodiment according to the invention is one in which a magnetic return force is provided for returning the valve body to the first switching state. For this purpose, it is expedient if the plate and/or the valve body are/is produced from a magnetic or magnetizable material. It is also possible that a preferably annular permanent magnet is provided on that side of the plate which faces away from the valve body, and/or on that side of the valve body which faces away from the plate, wherein the ring opening of the permanent magnet is in particular arranged approximately coaxially with respect to the throughflow opening in the valve body. Thus, an advantageous embodiment according to the invention can, for example, have an annular permanent magnet which is arranged on that side of the valve body facing away from the plate and which interacts with the plate produced from a magnetic or magnetizable material. In such an embodiment, the valve body in the first switching state is also pressed against the plate by means of the magnetic force, in such a way that the area lying between plate and valve body is well sealed in this switching state.

In one embodiment of the invention, provision can be made that, on an inflow-side end of the valve body, there is formed a guide element which, at least in the first switching state, engages with a counterpart guide element and guides at least one movement or change in shape of the valve body during the transfer from the first switching state to the second switching state, at least in a position-changing or shape-changing section. It is advantageous here that a defined change in shape can be supported by the guide element being guided in a predetermined trajectory. The counterpart guide element is preferably connected to the insert housing. It is advantageous here that it is possible to obtain a predetermined guide in relation to the insert housing.

In one embodiment of the invention, provision can be made that, on an inflow-side end of the valve body, there is formed a detent element which, in the first switching state, engages with a counterpart detent element connected to the insert housing. It is advantageous here that a trigger point can be defined from which a switching operation of the valve body is intended to start. This trigger point can be defined by the force that is needed to release or break up the locked connection between the detent element and the counterpart detent element counter to the locking direction. It is thus possible to avoid wobbling of the valve body during the transfer from the first switching state to the second switching state since, after the locked connection has been overcome, the force generated by the flow or by the water pressure is sufficient to transfer the valve body fully to the second switching state.

In one embodiment of the invention, provision can be made that the detent element is formed in an encircling manner around the valve body. It is advantageous here that the valve body can be retained all the way round on the counterpart detent element. A defined starting position can thus be established for the switching of the valve body. It is particularly expedient if the detent element is designed as an annular detent lug which engages in the counterpart detent element, which is designed as a corresponding annular groove or annular counterpart detent lug.

In one embodiment of the invention, provision can be made that the flow obstruction on the valve body is formed centrally in relation to at least one element, preferably several elements, from the group comprising: longitudinal axis of the valve body, elastic wall region, detent element, guide element and support. It is advantageous here that the acting force can be introduced centrally into the valve body, in order to obtain a defined change in shape.

In one embodiment of the invention, provision can be made that the or a support of the valve body has a reinforcement ring. It is advantageous here that a stable abutment can be made available for taking up a force acting on the valve body. The valve body can thus be acted on between the flow obstruction and the or a support element carrying the support, as a result of which the desired change in shape for the switch-over can be enforced. The reinforcement ring preferably encircles the first flow path. This has the advantage that the effect developed by a flow in the first flow path can be supported all the way round or even centrally.

In one embodiment of the invention, provision can be made that, in the second switching state, the valve body bears against a stop element which is connected to the insert housing. This has the advantage that it is possible to establish a defined end point for the switching movement to the second switching state. The stop element is preferably in the form of a peg. A simple means is thus made available for determining the second switching state of the valve body. For example, provision can be made that the stop element limits the or a change in position and/or shape of the valve body between the first switching state and the second switching state.

In one embodiment of the invention, provision can be made that the stop element forms a section, which is open at least in the second switching state, of the first flow path. It is advantageous here that the first flow path is not interrupted in the second switching state, and instead it remains available for water to flow through.

In one embodiment of the invention, provision can be made that a flow rate limiter is arranged in the first flow path, upstream of the valve body in the flow direction. It is advantageous here that controlled flow conditions can be established on the flow obstruction. A desired switching point of the valve body can thus be precisely determined. It is possible to avoid wobbling of the valve body when the switching conditions have been reached but not yet exceeded. Alternatively or in addition, provision can be made that a flow limiter is arranged in the second flow path, upstream of the valve body in the flow direction. It is particularly expedient if the first flow path and the second flow path have a common section running through the flow limiter.

The first flow path and the second flow path preferably have a common section and branch away from each other in the flow direction upstream of the valve body.

In one embodiment of the invention, provision can be made that the first flow path issues at the outlet end in a first outlet region and the second flow path issues at the outlet end in a second outlet region, wherein the second outlet region surrounds the first outlet region transversely with respect to a discharge direction. It is advantageous here that, when the valve body is in the second switching state, a jet of water emerging from the second outlet region can, like a curtain or screen, conceal a jet of water emerging from the first outlet region. Thus, a uniform and homogeneous appearance of the emerging jet of water can also be achieved in the second switching state of the valve body.

BRIEF DESCRIPTION OF THE DRAWINGS

The invention is now described in more detail on the basis of an illustrative embodiment, although it is not limited to this illustrative embodiment. Further illustrative embodiments are obtained by combining the features of one or more of the claims with one another and/or with one or more features of the illustrative embodiment.

In the drawing.

DETAILED DESCRIPTION OF THE PREFERRED EMBODIMENTS

Figure 1:
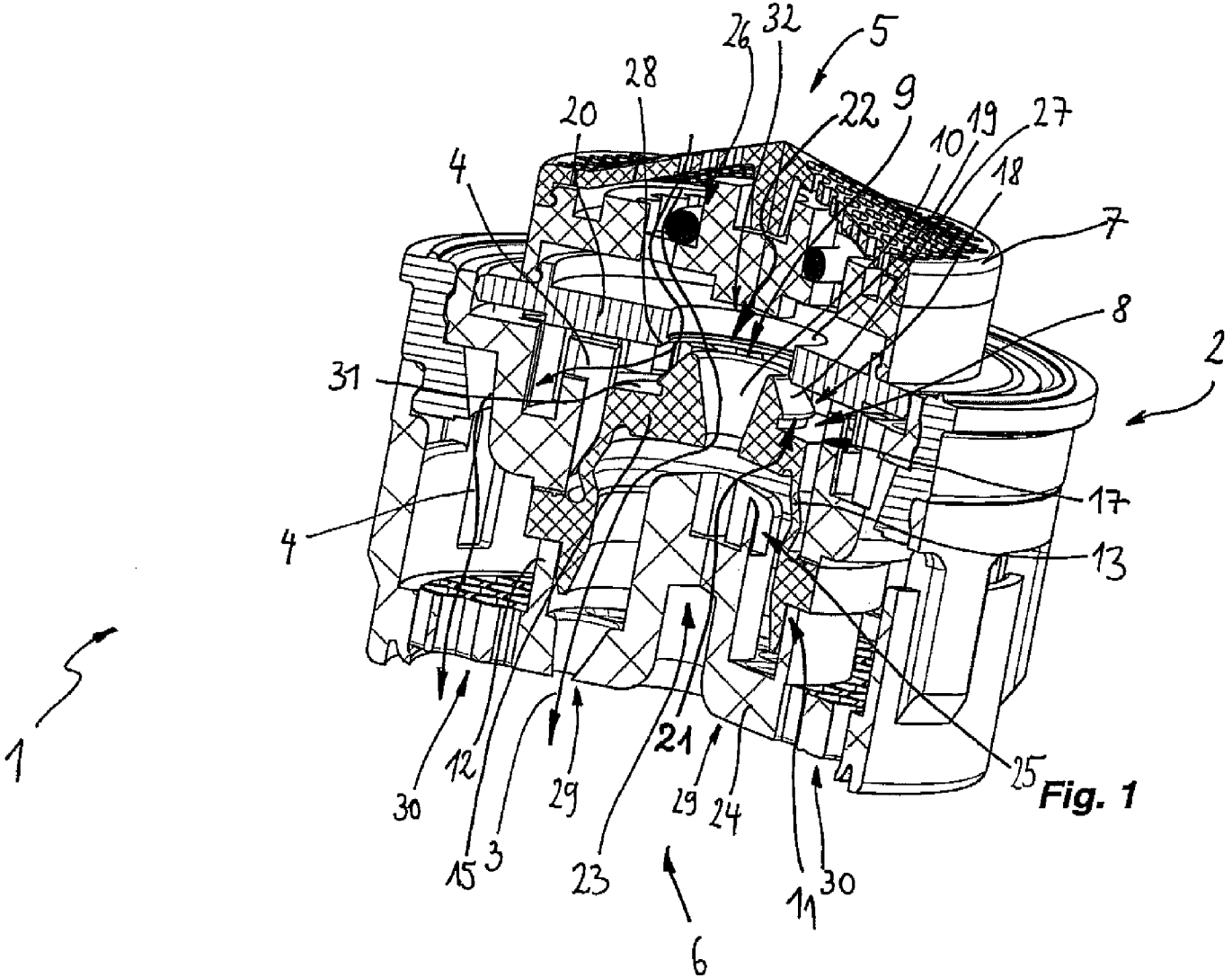
FIG. 1 shows a sanitary insert unit according to the invention in a partially sectioned view.

FIGS. 1 to 6 show two different designs of an insert unit, which is designated in its entirety by reference sign 1. In FIG. 1, one of these designs of the insert unit is shown in a segmented sectional view.

The insert unit 1 has a multi-part insert housing 2, which is designed to be inserted into a water outlet of a fitting (not shown here in detail).

A first flow path 3 and a second flow path 4 for flowing water are formed in the insert housing 2.

The first flow path 3 and the second flow path 4 run parallel to each other between an inlet opening 5 and an outlet end 6.

The inlet opening 5 is covered here by an inlet screen 7.

In use, the insert unit 1 is inserted into a water outlet of a water fitting in an orientation in which the flow first impinges on the inlet screen 7. The inlet opening 5 is thus arranged on the inflow side, whereas the outlet end 6 is arranged on the outflow side. The water therefore flows in a flow direction from the inlet opening 5 to the outlet end 6.

Arranged in the interior of the insert housing 2 there is a valve body 8, which is made in one piece from silicone or another rubber or generally from an elastic material. Silicone has the additional advantage that it is suitable for contact with food. Other elastic materials suitable for contact with food can also be used.

Figure 5:
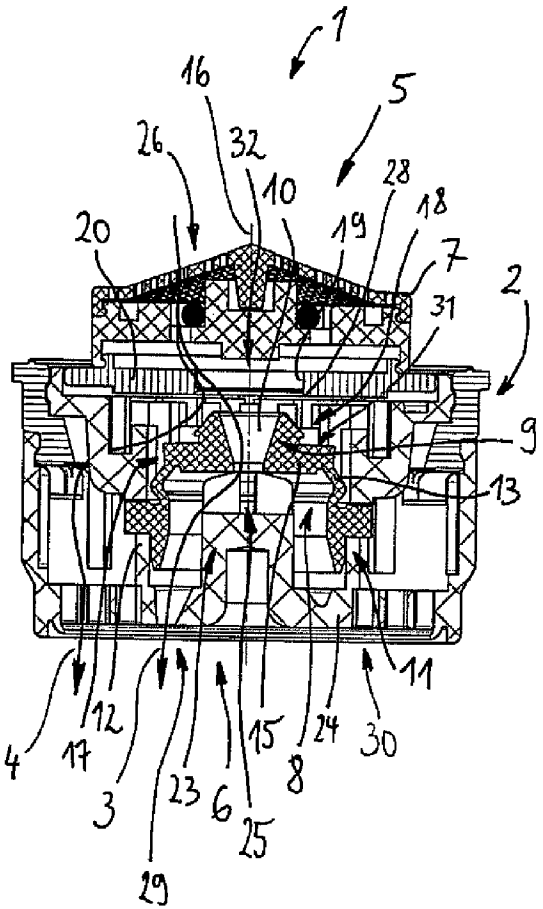
FIG. 5 shows the insert unit from FIG. 1 with the valve body located in the second switching state.
Figure 3:
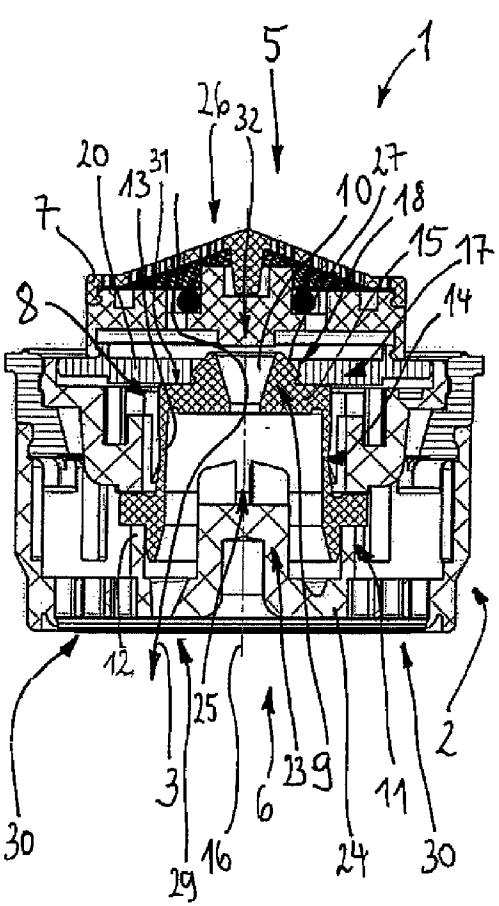
FIG. 3 shows the insert unit from FIG. 1 with the valve body located in the first switching state.
Figure 6:
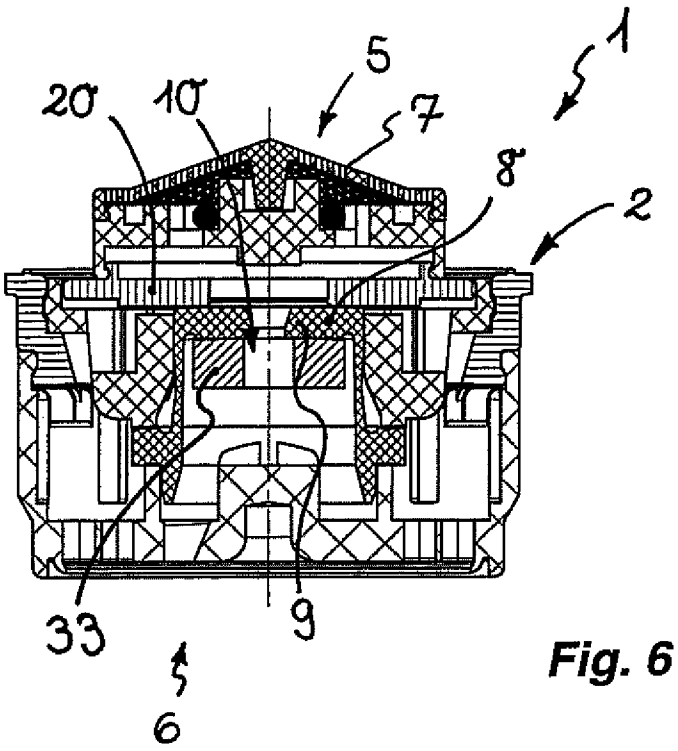
FIG. 6 shows an insert unit which is comparable to the insert unit of FIGS. 1 to 5 and in which a magnetic return force is additionally provided to reset the valve body.

This valve body 8 is adjustable between a first switching state, which is shown in FIGS. 3 and 6, and a second switching state, which is shown in FIG. 5.

Figure 4:
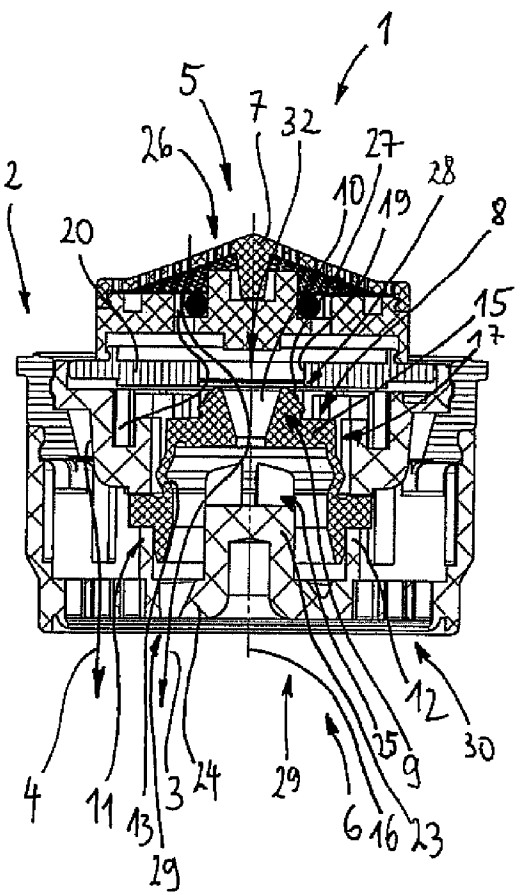
FIG. 4 shows the insert unit from FIG. 1 with the valve body located in an intermediate state between the first switching state and the second switching state.

FIG. 4 shows an intermediate state of the valve body 8 during the adjustment, i.e. the change in position and shape, between the first state and the second state.

FIG. 1 shows the valve body 8 likewise in an intermediate state.

Figure 2:
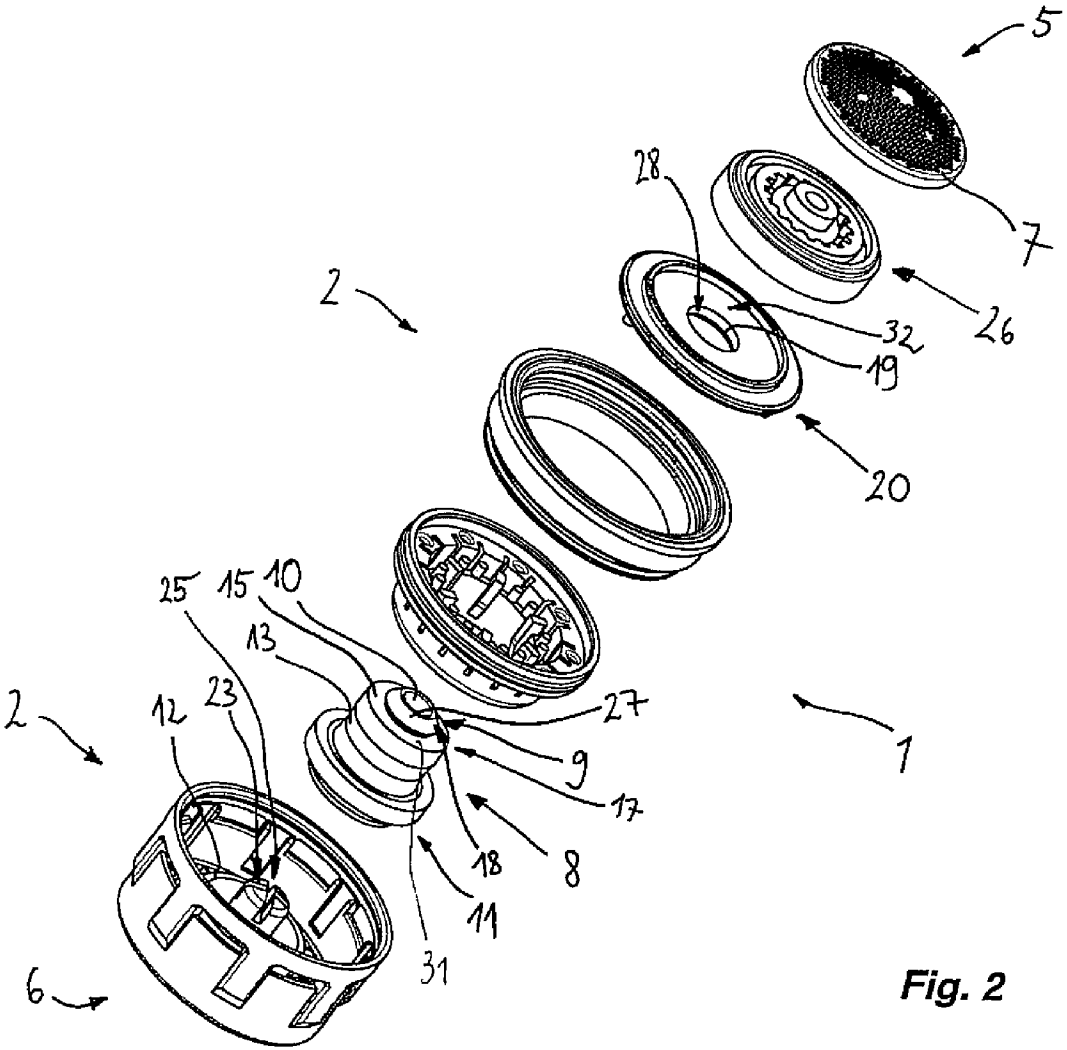
FIG. 2 shows the insert unit from FIG. 1 in an exploded view.

FIG. 2 shows the valve body 8 in a relaxed initial state, which corresponds to the first switching state substantially, i.e. except for an established pretensioning. It is clear from this that the valve body 8 returns automatically to the first switching state when not acted upon. This means that the adjustment, i.e. in the illustrative embodiment the change in shape, of the valve body 8 from the first switching state to the second switching state has to take place counter to a return force which the elastic valve body 8 itself develops on account of its elasticity.

In the first switching state, the valve body 8 frees the first flow path 3 and blocks the second flow path 4. By contrast, in the second switching state, the valve body 8 frees the first flow path 3 and at the same time the second flow path 4. Thus, in the second switching state of the valve body 8, the second flow path 4 is connected to the first flow path 3.

The valve body 8 can be transferred from the first switching state to the second switching state by a water pressure present at the inlet opening 5 or by a stream of water flowing in through the inlet opening 5.

For this purpose, a flow obstruction 9 is formed on the valve body 8. The flow obstruction 9 forms an increased flow resistance in the first flow path 3.

In the illustrative embodiment, the flow obstruction 9 is designed as a throughflow opening 10. The throughflow opening 10 has a clear diameter decreasing in the flow direction and therefore narrows conically in the flow direction.

On the outflow side, a support 11 is formed on the valve body 8, via which support 11 the valve body 8 is supported on a support element 12. The support 11 is designed as an annular reinforcement ring and comprises the first flow path 3 on the circumference.

The support element 12 is likewise annular and is connected to the insert housing 2.

The valve body 8 has an elastic wall region 13, which provides the stated return force.

In the first switching state according to FIG. 3, the elastic wall region 13 is cylindrical and surrounds a section of the first flow path 3. The valve body 8 is therefore designed as a hollow body.

The elastic wall region 13 has an annular region of material weakness 14 in which bending takes place when a pressure applied to the flow obstruction 9 exceeds a threshold value.

The elastic wall region 13 thus forms a bending zone. In the first switching state, the elastic wall region 13 has a rectilinear profile in a profile direction along the flow direction. In the second state, a bend is formed in the annular region of material weakness 14, such that the elastic wall region 13 adopts a bent profile in the profile direction. The bending causes the elastic wall region 13 to fold inward and/or outward in the profile direction.

In other words, the region of material weakness 14 defines a predetermined bending line, which runs on the elastic wall region 13 about a longitudinal axis 16 of the valve body 8.

On the inflow side, the elastic wall region 13 is adjoined by a plate-shaped face side 15. The throughflow opening 10 or generally the flow obstruction 9 is introduced centrally in the face side 15, i.e. in the center of the disk-shaped, round face side 15.

Compared to the elastic wall region 13, the face side 15 is comparatively stiff, such that the pressure applied to the flow obstruction 9 by the liquid flowing in the first flow path 3 can be transmitted as force to the elastic wall region 13.

In the first switching state, the force vector of this force extends inside the elastic wall region 13. Only when a threshold value is exceeded does the first wall region 13 bend, as a result of which the valve body 8 is transferred to the second switching state. As soon as the bending has started, the valve body 8 is moved to the second switching state, since the force for further material deformation is less than the initially required force.

The valve body 8 forms a pot shape together with the hollow cylindrical wall region 13 and the face side 15, and the opening located in the bottom of this pot shape is formed in the flow direction. The first flow path 3, which in sections extends in the valve body 8, therefore issues from the opening of the pot shape.

Overall, it will be seen that the valve body 8 is rotationally symmetrical about a longitudinal axis 16.

A guide element 18 is formed in the end 17 facing the flow direction. In the first switching state, the guide element 18 engages in a counterpart guide element 19.

The guide element 18 is peg-shaped. The counterpart guide element 19 is designed as a bore, of which the diameter is adapted to the guide element 18.

The counterpart guide element 19 is formed on a plate 20, which is connected to the insert housing 2. The counterpart guide element 19 thus forms a through-opening 32 in the plate 20 for the first flow path 3.

The counterpart guide element 19 supported on the insert housing 2 thus guides the valve body 8 at the start of the shape-changing movement in the transfer from the first switching state to the second switching state.

On the peg-shaped guide element 18, a detent element 21 is formed as an annular detent lug. On the counterpart guide element 19, a counterpart detent element 22 is provided in the form of a detent lug extending in a ring shape on the inside. The clear internal diameter of the counterpart detent element 22 is smaller than a maximum external diameter of the detent element.

Therefore, in the first switching state of the valve body 8, the detent element 21 engages behind the counterpart detent element 22. Thus, the interaction of the detent element 21 with the counterpart detent element 22 generates an additional resistance against a transfer from the first switching state to the second switching state.

In the first switching state according to FIG. 3, the second flow path 4 is interrupted by an annular sealing surface 31, which bears sealingly and flat on the plate 20. The sealing surface 31 is designed here on the face side 15 of the valve body 8 and, in the first switching state, rests flat on the plate 20 on the outflow side.

In the first switching state, the valve body 8 thus closes the through-opening 32 except for the through-flow opening 10.

The first switching state can be left only when the force applied to the flow obstruction 9 by the stream of liquid is sufficient both to release the locked connection between the detent element 21 and the counterpart detent element 22 and also to bend the elastic wall region 13.

Here, the flow obstruction 9 on the rotationally symmetrical valve body 8 is formed centrally in relation to the longitudinal axis 16, the cylindrical elastic wall region 13, the annular detent element 21, the peg-shaped, rotationally symmetrical guide element 18, and the annular or flange-shaped support 11. In other words, the flow obstruction 9, the elastic wall region 13, the detent element 21, the guide element 18 and the support 11 are arranged concentrically with respect to the longitudinal axis 16 of the rotationally symmetrical valve body 8, in order to introduce force as uniformly as possible into the elastic wall region 13 and to achieve an as far as possible rotationally symmetrical or uniform change in shape of the valve body 8.

The second switching state of the valve body 8 is defined by the stop element 23, which protrudes in the form of a peg from a screen plate 24. The screen plate 24 is connected to the insert housing 2. The support element 12 is also formed integrally on the screen plate 24.

The stop element 23 thus limits the shape-changing movement of the valve body 8 and forms a stop against the force introduced via the flow obstruction 9.

The intermediate state shown in FIG. 4 is adopted only briefly during a transfer, since the force needed for further bending of the elastic wall region 13 after formation of a first bend is much less than the force that was needed to form this first bend. The valve element 8 is thus transferred directly to the second switching state, as soon as the locked connection between detent element 21 and counterpart detent element 22 is released and the stated bending of the elastic wall region 13 has started.

In the second switching state, the now open second flow path 4 likewise runs through the through-opening 32. Downstream of the through-opening 32, a branching of the flow paths is thus formed where the second flow path 4 branches off from the first flow path 3.

At the inflow-side end of the stop element 23, two intersecting slits 25 are formed. In the second switching state, these slits 25 form an open section of the first flow path 3. The flow path 3 is therefore not closed in the second switching state and instead remains permeable or open.

The stop element 23 is also arranged concentrically with respect to the longitudinal axis 16.

As soon as the water pressure in the first flow path 3 drops sufficiently, the elastic wall region 13 returns to its hollow cylindrical starting shape. Thus, when the drop in pressure is sufficient, the valve body 8 is returned to the first switching state.

Conical bevels 27, 28 or chamfers on the detent element 21 and on the counterpart detent element 22 facilitate the engagement of the detent element 21 behind the counterpart detent element 22.

If the position of the flow obstruction 9 relative to the insert housing 2 or to the through-opening 32 is plotted as a function of the water pressure, this shows a hysteresis effect: First of all, the (static and/or dynamic) water pressure has to exceed a threshold value in order to trigger the change-over from the first switching state to the second switching state. As soon as this threshold value is exceeded, the transfer to the second switching state takes place in full. The valve body 8 remains in the second switching state until the water pressure has dropped below a second, lower threshold value, which can be overcome by the elastic tensioning force of the valve body 8. Only then can the valve body 8 be returned to the first switching state. This second threshold value is well below the first threshold value. It is thus possible to avoid intermediate states in which none of the switching states is adopted in a defined manner and in which the valve body instead wobbles out of control.

A flow rate limiter 26 of a type known per se is arranged upstream of the valve body 8 in the flow direction. The flow rate limiter 26 creates defined flow conditions at the flow obstruction 9, such that it is possible to precisely define the trigger point for the change-over from the first switching state to the second switching state, which is characterized by a threshold pressure value being exceeded.

A first outlet region 29 is formed at the outlet end 6. The water flowing via the first flow path 3 emerges at the first outlet region 29.

A second outlet region 30 is also formed at the outlet end 6. The water flowing via the second flow path 4 emerges at the second outlet region 30.

The second flow path 4 is designed for admixing air to the flow of water. The water emerging from the second outlet region 30 therefore has a milky appearance. By contrast, the jet of water from the first outlet region 29, i.e. from the first flow path 3, appears clear.

The second outlet region 30 surrounds the first outlet region 29 in a ring shape and transversely with respect to the direction of emergence of the water from the outlet end 6, such that the first outlet region 29 lies inside the second outlet region 30. Thus, the water emerging from the second outlet region 30 in the second switching state forms a water jet in the shape of a hollow cylinder. In the interior of this hollow cylinder, the clear jet of water emerging from the first outlet region 29 is concealed behind the milky jet of water. Since the second flow path encloses the first flow path at least at the outlet side, the water emerging from the first flow path is surrounded fully and in an opaque manner by the water emerging from the second flow path.

The insert unit 1 shown in a longitudinal section in FIG. 6 corresponds substantially to the embodiment shown in FIGS. 1 to 5. However, in the insert unit 1 according to FIG. 6, a magnetic return force is additionally provided, or in this case instead provided, for returning the valve body 8 to the first switching state. For this purpose, the plate 20 of the illustrative embodiment shown in FIG. 6 is produced from a magnetic or magnetizable material, while an annular permanent magnet 33 is arranged on that side of the valve body facing away from the plate 20. This annular permanent magnet 33, of which the ring opening is arranged approximately coaxially with respect to the opening located in the bottom of the pot-shaped valve body 8, interacts with the magnetic or magnetizable material of the plate 20 in such a way that, in the insert unit 1 shown in FIG. 6, a magnetic return force also acts on the valve body 8. Not only does this magnetic return force serve to actuate the valve body 8, it also at the same time provides an effective seal of the area located between the plate 20 and the adjacent flat face of the valve body 8 in the first switching state. It is advantageous here that the field strength of this magnetic return force decreases quadratically with the distance of the valve body 8 from the plate 20.

In a sanitary insert unit 1 having an elastically deformable valve body 8 which can be switched between a first switching state and a second switching state, it is provided to form a first flow path 3 and a second flow path 4 and to block the second flow path 4 in the first switching state and open it in the second switching state, wherein the first flow path 3 is open in the first switching state and in the second switching state.

LIST OF REFERENCE SIGNS

1 insert unit
2 insert housing
3 first flow path
4 second flow path
5 inlet opening
6 outlet end
7 inlet screen
8 valve body
9 flow obstruction
10 throughflow opening
11 support
12 support element
13 elastic wall region
14 region of material weakness
15 face side
16 longitudinal axis
17 inflow-side end of the valve body
18 guide element
19 counterpart guide element
20 plate
21 detent element
22 counterpart detent element
23 stop element
24 screen plate
25 slit
26 flow rate limiter
27 bevel
28 bevel
29 first outlet region
30 second outlet region
31 sealing surface
32 through-opening
33 permanent magnet

The invention claimed is:

1. A sanitary insert unit (1), comprising an insert housing (2) having a first flow path (3) and a second flow path (4) defined therein, the first flow path (3) and the second flow path (4) extend in each case between at least one inflow-side inlet opening (5) and one outflow-side outlet end (6), a valve body (8) that is adjustable from a first switching state into a second switching state counter to a return force, the second flow path (4) is closed by the valve body (8) in the first switching state and is open in the second switching state, a flow obstruction (9) is formed on the valve body (8) that is arranged along the first flow path (3) and is acted upon by a force from water pressure in the first flow path to move the valve body from the first switching state to the second switching state upon a threshold force being exceeded, the first flow path (3) is open in the first switching state and in the second switching state, and the valve body (8) is formed with a circumferentially extending elastic wall region (13) that returns the valve body to the first switching state for the water pressure being below the threshold force, the circumferentially extending elastic wall region having an annular region of material weakness that forms a bending zone wherein in the first switching state, the circumferentially extending elastic wall region (13) has a rectilinear profile in a profile direction along a flow direction through the sanitary insert unit (1), and in the second switching state, a bend is formed in the annular region of material weakness (14), such that the circumferentially extending elastic wall region (13) adopts a bent profile in the profile direction, and the bent profile is formed as at least one of an inward or outward fold in a radial direction in the circumferentially extending elastic wall region (13), wherein the radial direction is perpendicular to the flow direction.

2. The sanitary insert unit (1) as claimed in claim 1, wherein the flow obstruction (9) comprises a narrowing of a throughflow opening (10) in a flow direction.

3. The sanitary insert unit (1) as claimed in claim 1, wherein the flow obstruction (9) is formed on an inflow-side end (17) of the valve body (8).

4. The sanitary insert unit (1) as claimed in claim 1, wherein, at an outflow side, the valve body (8) is supported, via a support (11), on a support element (12) which is connected to the insert housing (2).

5. The sanitary insert unit (1) as claimed in claim 1, wherein the valve body (8) is transferable from the first switching state into the second switching state by a change in shape.

6. The sanitary insert unit (1) as claimed in claim 1, wherein the elastic wall region (13) of the valve body (8) has a rectilinear profile along a profile direction in the first switching state, and has a bent profile along the profile direction in the second switching state.

7. The sanitary insert unit (1) as claimed in claim 1, wherein the elastic wall region (13) is of hollow cylindrical form and defines a portion of the first flow path (3).

8. The sanitary insert unit (1) as claimed in claim 1, wherein the valve body (8) comprises a hollow body and defines at a portion of the first flow path (3).

9. The sanitary insert unit (1) as claimed in claim 1, wherein the valve body (8) is at least one of pot-shaped or rotationally symmetrical in form, and the flow obstruction (9) is arranged on a face side (15) thereof.

10. The sanitary insert unit (1) as claimed in claim 9, wherein the face side (15) is plate-shaped, and the flow obstruction is arranged centrally in relation to the face side (15).

11. The sanitary insert unit (1) as claimed in claim 1, wherein the valve body (8) and the elastic wall region (13) are produced in unipartite form from an elastic material.

12. The sanitary insert unit (1) as claimed in claim 1, wherein an inherent elasticity of a material used for the valve body (8) is provided for generating the return force for returning the valve body into the first switching state.

13. A sanitary insert unit (1), comprising an insert housing (2) having a first flow path (3) and a second flow path (4) defined therein, the first flow path (3) and the second flow path (4) extend in each case between at least one inflow-side inlet opening (5) and one outflow-side outlet end (6), a valve body (8) that is adjustable from a first switching state into a second switching state counter to a return force, the second flow path (4) is closed by the valve body (8) in the first switching state and is open in the second switching state, a flow obstruction (9) is formed on the valve body (8) that is arranged along the first flow path (3), the first flow path (3) is open in the first switching state and in the second switching state, and the return force is a magnetic return force that returns the valve body (8) into the first switching state.

14. The sanitary insert unit (1) as claimed in claim 13, wherein at least one of an insert plate (20) located in the housing or the valve body (8) are produced from a magnetic or magnetizable material.

15. The sanitary insert unit (1) as claimed in claim 14, wherein a permanent magnet (33) is provided on a side of the valve body (8) which faces away from the plate (20).

16. The sanitary insert unit (1) as claimed in claim 1, wherein on an inflow-side end (17) of the valve body (8), there is formed a detent element (21) which, in the first switching state, engages with a counterpart detent element (22) connected to the insert housing (2).

17. The sanitary insert unit (1) as claimed in claim 16, wherein the detent element (21) is formed in an encircling manner around the valve body (8).

18. The sanitary insert unit (1) as claimed in claim 1, wherein the flow obstruction (9) on the valve body (8) is formed centrally in relation to at least one element from a group consisting of: a longitudinal axis (16) of the valve body (8), an elastic wall region (13) of the valve body, a detent element (21) on the valve body, a guide element (18) of the valve body, or a support (11) of the valve body.

19. The sanitary insert unit (1) as claimed in claim 1, wherein the valve body (8) includes a support (11) with a reinforcement ring encircling the first flow path (3).

20. The sanitary insert unit (1) as claimed in claim 1, wherein, in the second switching state, the valve body (8) bears against a stop element (23) which is connected to the insert housing (2).

21. The sanitary insert unit (1) as claimed in claim 20, wherein the stop element is in the form of a peg or limits a change in shape of the valve body between the first switching state and the second switching state.

22. The sanitary insert unit (1) as claimed in claim 20, wherein the stop element (23) forms a section which is open at least in the second switching state of the first flow path (3).

23. The sanitary insert unit (1) as claimed in claim 1, wherein a flow rate limiter (26) is arranged in at least one of the first flow path (3) or the second flow path (4), upstream of the valve body (8) in a flow direction.

24. The sanitary insert unit (1) as claimed in claim 1, wherein the first flow path (3) issues at the outlet end (6) in a first outlet region (29) and the second flow path (4) issues at the outlet end (6) in a second outlet region (30), and the second outlet region (30) surrounds the first outlet region (29) transversely with respect to a discharge direction.

25. The sanitary insert unit (1) as claimed in claim 1, wherein the second flow path surrounds the first flow path at least at the outlet side such that water emerging from the first flow path is at least one of surrounded fully or in an opaque manner by the water emerging from the second flow path.

* * * * *